US006996868B1

(12) United States Patent
Milano et al.

(10) Patent No.: US 6,996,868 B1
(45) Date of Patent: Feb. 14, 2006

(54) MULTI-PURPOSE TOOL

(76) Inventors: Paul Milano, 113 Linton St., Torrington, CT (US) 06790; Randy Gurski, 19 Linton St., Torrington, CT (US) 06790

( * ) Notice: Subject to any disclaimer, the term of this patent is extended or adjusted under 35 U.S.C. 154(b) by 127 days.

(21) Appl. No.: 10/842,415

(22) Filed: May 11, 2004

(51) Int. Cl.
*B26B 11/00* (2006.01)

(52) U.S. Cl. ..... 7/105; 7/156; 7/138

(58) Field of Classification Search ..... 7/105, 7/165, 138, 158; 30/123, 62
See application file for complete search history.

(56) References Cited

U.S. PATENT DOCUMENTS

| | | | | |
|---|---|---|---|---|
| D150,156 | S | 7/1948 | Neil | |
| 3,286,749 | A | 11/1966 | Learned | |
| 4,016,614 | A | 4/1977 | Press | |
| 4,325,153 | A | 4/1982 | Finnegan | |
| 4,858,504 | A | 8/1989 | Tsai | |
| D333,964 | S | 3/1993 | Alexander | |
| 5,956,789 | A * | 9/1999 | Chou | 7/108 |
| 6,019,022 | A | 2/2000 | Dotson | |
| 6,131,222 | A * | 10/2000 | Anderson et al. | 7/105 |
| 6,272,952 | B1 * | 8/2001 | Hsu et al. | 81/57.22 |
| 6,276,014 | B1 * | 8/2001 | Lee | 7/158 |
| 6,298,755 | B1 * | 10/2001 | England | 81/438 |
| 6,352,010 | B1 | 3/2002 | Giarritta et al. | |

* cited by examiner

*Primary Examiner*—Lee D. Wilson
(74) *Attorney, Agent, or Firm*—Donald R. Schoonover

(57) ABSTRACT

A tool includes a handle and a sleeve on the handle. A multi-component slot is defined in the handle and the sleeve is attached to the handle by a set screw. A plurality of different screwdriver units can be mounted on one end of the handle and a plurality of different tools can be releasably mounted on the other end of the handle. The tools are held in place by a projection on the tool being received in a hole on the handle and the screwdriver units are held on the handle by the set screw. Biasing elements are accommodated in the handle and bias the tool and the screwdriver units outwardly of the handle.

2 Claims, 1 Drawing Sheet

MULTI-PURPOSE TOOL

BACKGROUND OF THE INVENTION

1. Field of the Invention

The present invention relates to the general art of tools, and to the particular field of multipurpose tools.

2. Discussion of the Related Art

In carrying out nearly any work task, a worker often requires various tools. Workmen in the construction industry often require several tools for most tasks. These tools include screwdrivers of all types, scrapers, and the like. These tools are often carried by the worker in a toolbox, or in some form of carrier, or on a belt. Painters, machinists and the like are examples of workmen who often require multiple tools to complete a task.

However, carrying multiple tools can be cumbersome, and changing tools may be difficult and inconvenient.

Therefore, there is a need for a tool that can fulfill multiple uses.

The art contains many examples of tools that can serve a wide variety of purposes. Many tools have a handle which can accommodate numerous different tools, such as a handle that can accommodate blade or Phillips head screwdrivers. However, the tools known to the inventor do not have an ability to adapt to a wide enough variety of tools to be as useful as possible.

Therefore, there is a need for a tool that can fulfill multiple uses in an efficient manner while using a minimum of space.

Do-it-yourself workers often do not have space or funds for a wide variety of tools. These people often try to complete a job while using less than effective tools, or even the wrong tools and the job is either not completed or not completed in a proper manner. Often, this is not because the person lacks the skill, it is often because the person does not have the proper tools. It is noted that the term "do-it-yourself" can be applied to fairly skilled people as well as total novices.

Therefore, there is a need for a tool that can fulfill multiple uses in an efficient manner and is easily used and accessible to a do-it-yourself worker.

PRINCIPAL OBJECTS OF THE INVENTION

It is a main object of the present invention to provide a tool that can fulfill multiple uses.

It is another object of the present invention to provide a tool that can fulfill multiple uses in an efficient manner while using a minimum of space.

It is another object of the present invention to provide a tool that can fulfill multiple uses in an efficient manner and is easily used and accessible to a do-it-yourself worker.

SUMMARY OF THE INVENTION

These, and other, objects are achieved by a multipurpose tool that has a handle which is adapted to accommodate tools on one end and screwdrivers on the other end and which has elements that can easily and quickly lock and unlock those tools on the handle. Springs bias the tools and screwdrivers in a direction that makes removal easy and quick, and a movable handle is used to control locking and unlocking of the tools on the handle.

Using the multipurpose tool embodying the present invention will permit a worker to carry a wide variety of tools on his or her person in a minimum amount of space while having all of the tools readily accessible when needed. The tool is easy to use and thus can easily be used by a do-it-yourself worker.

BRIEF DESCRIPTION OF THE DRAWING FIGURES

DETAILED DESCRIPTION OF THE PREFERRED EMBODIMENT

Figures 1, 2, 3, 4:
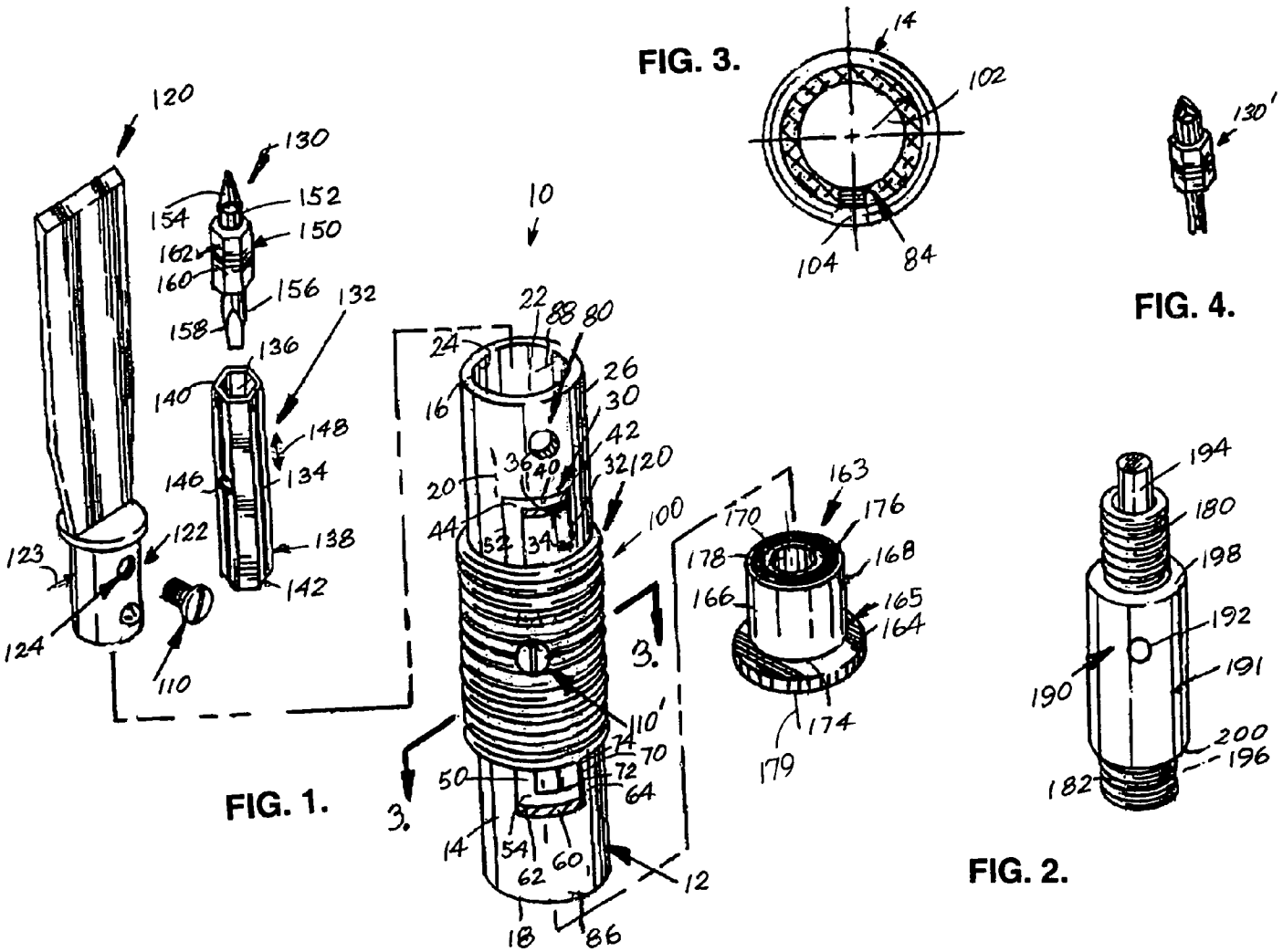
FIG. 1 is an exploded perspective view of a multipurpose tool embodying the present invention.
FIG. 2 is a perspective view of a screwdriver housing used in the tool embodying the present invention.
FIG. 3 is a cross-sectional view taken along line 3—3 of FIG. 1.
FIG. 4 is a perspective view of a Phillips head screwdriver that can be used with the tool embodying the present invention.

Other objects, features and advantages of the invention will become apparent from a consideration of the following detailed description and the accompanying drawings.

Referring to the Figures, it can be understood that the present invention is embodied in a multipurpose tool 10. Tool 10 comprises a handle unit 12 which will be held in a user's hand and which includes a hollow cylindrical body 14.

Body 14 can be formed of steel or aluminum or other suitable material and includes a first end 16, a second end 18, and a longitudinal axis 20 which extends between the first end 16 of the body 14 and the second end 18 of the body 14.

A bore 22 extends from the first end 16 of the body 14 to the second end 18 of the body 14, and the body 14 has an inside surface 24 adjacent to the bore 22 and an outside surface 26.

A compound slot 30 is defined through the body 14. Slot 30 includes a first portion 32, which extends in the direction of the longitudinal axis 20 and which has a first end 34 and a second end 36. The compound slot 30 further includes a second portion 40, which extends transverse to the longitudinal axis 20 and which has a first end 42 connected to the second end 36 of the first portion 32 and a second end 44.

The compound slot 30 further includes a third portion 50 which extends in the direction of the longitudinal axis 20 and which is spaced apart from the first portion 32. Third portion 50 has a first end 52 connected to the second end 44 of the second portion 40 and a second end 54.

The compound slot 30 further includes a fourth portion 60, which extends transverse to the longitudinal axis 20 and which has a first end 62 connected to the second end 54 of the third portion 50 and a second end 64.

The compound slot 30 further includes a fifth portion 70, which has a first end 72 connected to the second end 64 of the fourth portion 60 and a second end 74. Fifth portion 70 extends parallel to the first and third portions 32, 50 and is co-linear with the first portion 32.

Fourth portion 60 is parallel to the second portion 40, and the first and third portions 32 and 50 are parallel to each other.

A locking projection-accommodating hole 80 is defined through the body 14 near the first end 16 of the body 14 for a purpose that will be understood from the teaching of the following disclosure.

A threaded bore 84 is defined through the body 14 adjacent to the third portion 50 of the compound slot 30.

Body 14 has an outer diameter 86 and an inner diameter 88.

A sliding sleeve 100 is cylindrical and has an inner diameter 102 that is larger than the outer diameter 86 of the body 14 of the handle unit 12 and which further includes a threaded bore 104 therethrough which is aligned with the threaded bore 84 in the body 14 of the handle unit 12 when the sliding sleeve 100 is in a use position on the handle unit 12 as shown in FIG. 1.

A set screw 110 extends through the threaded bore 104 defined in the sliding sleeve 100 and through the threaded bore 84 defined through the body 14 of the handle unit 12 when the set screw is in a use position as shown at 110' in FIG. 1.

A tool unit 120 includes a cylindrical base 122 which has an outer diameter 123 that is slightly smaller than the inner diameter 88 of the body 14 of the handle unit 12 and which is slidably accommodated in the body 14 of the handle unit 12 adjacent to the first end 16 of the body 14 of the handle unit 12 when the tool unit 120 is in place on the handle unit 12.

A locking projection 124 is located on the base 122 of the tool unit 120. The locking projection 124 is located to be accommodated in locking projection-accommodating hole 80 defined through body 14 near the first end 16 of body 14 when the tool unit 120 is in place on the handle unit 12.

A screwdriver unit 130 includes an adapter sleeve 132. Adapter sleeve 132 includes a hollow cylindrical body 134, which has an inner dimension 136 and an outer dimension 138. Outer dimension 138 of the cylindrical body 134 of the adapter sleeve 132 is smaller than the inner diameter 88 of the cylindrical body 14 of the handle unit 12 so the adapter sleeve 132 can fit inside the body 14 of the handle unit 12.

Adapter sleeve 132 further includes a first end 140 and a second end 142, which is located adjacent to the second end 18 of the cylindrical body 14 of the handle unit 12 when the screwdriver unit 130 is in place inside the cylindrical body 14 of the handle unit 12.

A threaded set screw-accommodating hole 146 is defined through the cylindrical body 134 of the screwdriver unit 130 and is located to be aligned with the threaded bore 84 defined through the body 14 of the handle unit 12 when the adapter sleeve 132 is in place inside the cylindrical body 14 of the handle unit 12.

Adapter sleeve 132 further includes a longitudinal axis 148 which extends between the first end 140 of the adapter sleeve 132 and the second end 142 of the adapter sleeve 132 and which is co-linear with the longitudinal axis 20 of the cylindrical body 14 of the handle unit 12 when the adapter sleeve 132 is in place inside the cylindrical body 14 of the handle unit 12.

A screwdriver element 150 has a first end 152 with a first screw-contacting driver element 154 thereon, a second end 156 with a second screw-contacting driver element 158 thereon, and a body 160. Body 160 has an outer dimension 162 that is slightly smaller than the inner dimension 136 of the body 134 of the adapter sleeve 132 so the body 160 of the screwdriver element 150 can be accommodated inside the body 134 of the adapter sleeve 132 when the screwdriver element 150 is in use. One of the first and second ends 152, 156 of the screwdriver element 150 will be located outside the body 14 of the handle unit 12 when the screwdriver element 150 is in use.

A cap unit 163 includes a flange plate 164 which has an outer dimension 165 that is greater than the outer diameter 86 of the body 14 of the handle unit 12.

Cap unit 163 further includes a cylindrical body 166 which has an outer dimension 168 that is slightly smaller than the inner diameter 88 of the body 14 of the handle unit 12 and is sized and adapted to be accommodated inside the hollow body 14 of the handle unit 12 adjacent to the second end 36 of the body 14 of the handle unit 12 when in use. The body 166 of the cap unit 163 has a bore 170 defined therethrough. Bore 170 is sized to be slightly larger than the outer dimension 138 of the body 134 of the adapter sleeve 132 of the screwdriver unit 130 so that the body 134 of the adapter sleeve 132 of the screwdriver unit 130 is slidably accommodated in the bore 170 defined through the body 166 of the cap unit 163 when the screwdriver unit 130 is in use. The body 166 of the cap unit 163 has a first end 174, which is integral with the flange plate 164, and a second end 176, which has a chamfer 178 thereon and which is located inside the body 14 of the handle unit 12 when the cap unit 163 is in place on the handle unit 12. Chamfer 178 can be oriented at a 45° angle with respect to a longitudinal axis 179 of the cap unit 165.

The flange plate 164 of the cap unit 163 is in abutting contact with the body 14 of the handle unit 12 adjacent to the second end 18 of the body 14 of the handle unit 12 when the cap unit 163 is in place on the body 14 of the handle unit 12.

A first biasing element 180 is located to be interposed between the tool unit 120 and the screwdriver unit 130 when both the screwdriver unit 130 and the tool unit 120 are in place on the handle unit 12.

A second biasing element 182 is located to be interposed between the screwdriver unit 130 and the cap unit 163 when both the screwdriver unit 130 and the cap unit 163 are in place on the handle unit 12.

The tool 10 further includes a biasing element-supporting element 190 which is located inside the body 14 of the handle unit 12 and which is attached to the sliding sleeve 100 by set screw 110, which is accommodated in a threaded bore 192 defined in body 191 of element 190 so the biasing element-supporting element 190 can move with the sliding sleeve 100. Element 190 further includes a first projection 194, which supports first biasing element 180, and a second projection 196, which supports second biasing element 182. The projections 194, 196 are sized with respect to body 191 to define abutting shoulders 198 and 200 against which the biasing elements 180, 182 rest. The biasing elements 180, 182 thus are anchored with respect to the handle 12 by the set screw and bias the tool unit 120 and/or the screwdriver unit 130 outwardly of the body 14 of the handle 12. By removing set screw 110, and sliding the sleeve 100 toward the second end 18 of the body 14 of the handle unit 12, the screwdriver element 150 can be ejected from the body 14 of the handle 12. The screwdriver unit 130 can then be used to force locking projection 124 out of locking projection-accommodating hole 80 to free the tool unit 120 from the handle unit 12.

Use of the tool 10 is effected by selecting one of the plurality of screwdriver elements and placing it on the handle 12 using the adapter sleeve 132, which is accommodated on the cap unit 163. A biasing element, such as a spring, is placed on the screwdriver element 150 and a tool is then snapped into place on the body 14 of the handle unit 12 with a biasing element located between the tool unit and the screwdriver element 150. After use, a screwdriver element 150 is used to force projection 124 back out of hole 80 to release the tool from the handle unit 12. Screw 110 can be backed out to release the sleeve 100 and the screwdriver element 150 from the body 14 of the handle element 12.

It is noted that a plurality of different tools and/or screwdriver units can be used in combination with the handle unit 12 so the tool 10 is quite versatile. A second screwdriver element 130' is shown in FIG. 4.

It is understood that while certain forms of the present invention have been illustrated and described herein, it is not to be limited to the specific forms or arrangements of parts described and shown.

What is needed and desired to be covered by Letters Patent is as follows:

1. A multipurpose tool comprising:

a) a handle unit which includes (1) a hollow cylindrical body which includes (A) first end, (B) a second end, (C) a longitudinal axis which extends between the first end of the body and the second end of the body, (D) a bore which extends from the first end of the body to the second end of the body, (E) an inside surface adjacent to the bore, (F) an outside surface, (G) a compound slot defined through the body and which includes (i) a first portion which extends in the direction of the longitudinal axis and which has a first end and a second end, (ii) a second portion which extends transverse to the longitudinal axis and which has a first end connected to the second end of the first portion and a second end, (iii) a third portion which extends in the direction of the longitudinal axis and which is spaced apart from the first portion and which has a first end connected to the second end of the second portion and a second end, (iv) a fourth portion which extends transverse to the longitudinal axis and which has a first end connected to the second end of the third portion and a second end, (v) a fifth portion that has a first end connected to the second end of the fourth portion and a second end and which extends parallel to the first and third portions and which is co-linear with the first portion, (vi) the fourth portion being parallel to the second portion and the first and third portions being parallel to each other, and (H) a locking projection-accommodating hole defined through the body near the first end of the body, (2) a threaded bore defined through the body adjacent to the third portion of the compound slot, and (3) an outer diameter, and (4) an inner diameter;

b) a sliding sleeve which is cylindrical and which has an inner diameter that is larger than the outer diameter of the body of said handle unit and which further includes a threaded bore therethrough and which is aligned with the threaded bore in the body of said handle unit when said sliding sleeve is in a use position on said handle unit;

c) a set screw that extends through the threaded bore defined in said sliding sleeve and through the threaded bore defined through the body of said handle unit when the set screw is in a use position;

d) a tool unit which includes (1) a cylindrical base having an outer diameter that is slightly smaller than the inner diameter of the body of said handle unit and which is slidably accommodated in the body of said handle unit adjacent to the first end of the body of said handle unit when said tool unit is in place on said handle unit, and (2) a locking projection on the base of said tool unit, the locking projection being located to be accommodated in the locking projection-accommodating hole defined through the body of said handle unit near the first end of the body of said handle unit when said tool unit is in place on said handle unit, e) a screwdriver unit which includes (1) an adapter sleeve which includes (A) a hollow cylindrical body having an inner dimension and an outer dimension, the outer dimension of the cylindrical body of the adapter sleeve being smaller than the inner diameter of the cylindrical body of said handle unit, (B) a first end, (C) a second end which is located adjacent to the second end of the cylindrical body of said handle unit when said screwdriver unit is in place inside the cylindrical body of said handle unit, (D) a threaded setscrew-accommodating hole defined through the cylindrical body of said screwdriver unit and which is located to be aligned with the threaded bore defined through the threaded bore defined through the body of said handle unit when the adapter sleeve is in place inside the cylindrical body of said handle unit, and (E) a longitudinal axis which extends between the first end of the adapter sleeve and the second end of the adapter sleeve and which is co-linear with the longitudinal axis of the cylindrical body of said handle unit when the adapter sleeve is in place inside the cylindrical body of said handle unit, and (2) a screwdriver element which has (A) a first end with a first screw-contacting driver element thereon, (B) a second end with a second screw-contacting driver element thereon, and (C) a body which has an outer dimension that is slightly smaller than the inner dimension of the body of the adapter sleeve, the body of the screwdriver element being accommodated inside the body of the adapter sleeve when the screwdriver element is in use, one of the first and second ends of the screw-contacting driver element being located outside the body of said handle unit when the screwdriver element is in use;

f) a cap unit which includes (1) a flange plate which has an outer dimension that is greater than the outer diameter of the body of said handle unit, (2) a cylindrical body which has an outer dimension that is slightly smaller than the inner diameter of the body of said handle unit and is sized and adapted to be accommodated inside the hollow body of said handle unit adjacent to the second end of the body of said handle unit when in use, the body of said cap unit having a bore defined therethrough which is sized to be slightly larger than the outer dimension of the body of the adapter sleeve of said screwdriver unit so that the body of the adapter sleeve of said screwdriver unit is slidably accommodated in the bore defined through the body of said cap unit when said screwdriver unit is in use, the body of said cap unit having a first end integral with the flange plate and a second end which has a chamfer thereon and which is located inside the body of said handle unit when said cap unit is in place on said handle unit, and (3) the flange plate of said cap unit being in abutting contact with the body of said handle unit adjacent to the second end of the body of said handle unit when said cap unit is in place on the body of said handle unit;

g) a first biasing element which is located to be interposed between said tool unit and said screwdriver unit when both said screwdriver unit and said tool unit are in place on said handle unit;

h) a second biasing element which is located to be interposed between said screwdriver unit and said cap unit when both said screwdriver unit and said cap unit are in place on said handle unit; and i) a biasing element supporting body which is located inside the body of said handle unit and which includes (1) a first section having a threaded bore defined therein to be located adjacent to the threaded bore defined through the body of said handle unit and to accommodate the set screw to attach said biasing element-supporting body to said sliding sleeve, (2) a first projection which is located on the longitudinal axis of the body of said handle unit when said biasing element-supporting body is in place inside the body of said handle unit and which supports said first biasing element, (3) a second projection which is located on the longitudinal axis of the body of said handle unit when said biasing element-supporting body is in place inside the body of said handle unit and which supports said second biasing element, and (4) the first and second projections of said biasing element-supporting body being sized with respect to the first section of said biasing element-supporting body so the first section of said biasing element-supporting body forms a biasing element abutting rest for said first and second biasing elements.

2. The multipurpose tool as described in claim 1 further including a second screwdriver unit.

* * * * *